US005638763A

United States Patent [19]

Kelsey

[11] Patent Number: 5,638,763

[45] Date of Patent: Jun. 17, 1997

[54] CORNER REEFING SAIL

[76] Inventor: Kevin Kelsey, 11538 Riviera Pl. NE., Seattle, Wash. 98125-5921

[21] Appl. No.: 501,611

[22] Filed: Jul. 12, 1995

[51] Int. Cl.[6] ..... B63H 9/10

[52] U.S. Cl. ..... 114/105; 114/103

[58] Field of Search ..... 114/103, 104, 114/105, 111, 112, 108, 39.1, 102

[56] References Cited

U.S. PATENT DOCUMENTS

| | | | |
|---|---|---|---|
| 4,487,147 | 12/1984 | Hoyt | 114/104 |
| 4,612,868 | 9/1986 | Reynolds | 114/39 |
| 4,688,506 | 8/1987 | Van Breems | 114/104 |
| 4,706,591 | 11/1987 | Reynolds | 114/103 |
| 4,967,680 | 11/1990 | Dailey et al. | 114/104 |
| 5,272,996 | 12/1993 | Drexler | 114/103 |

FOREIGN PATENT DOCUMENTS

| | | | |
|---|---|---|---|
| 111987 | 6/1984 | European Pat. Off. | 114/103 |
| 2422551 | 12/1979 | France | 114/104 |
| 2714271 | 10/1978 | Germany | 114/104 |
| 2823418 | 12/1979 | Germany | 114/39.2 |
| 3903167 | 8/1989 | Germany | 114/103 |

OTHER PUBLICATIONS

Bratt, RA "Shooting Star" Sail Trimming, Testing + Theory AYRS #76, Amatuer Yacht Research Society, Apr. 1971, pp. 68–71.

Edwards, Michael "Swing-Wing" Foils + Hapas AYRS #108, Amatuer Yacht Research Society, May 1991, pp. 5–6.

Taylor, Glenn "Windsurfing—The Complete Guide" McGraw-Hill, 1979, pp. 245–246.

*Primary Examiner*—Sherman Basinger

[57] ABSTRACT

A sailing rig (20) has a sail cloth (26) adjustable in area by folding of the aft corner of sail (26), a clew sail (38). Sail cloth (26) is redesigned so clew sail (38) is not a structural part of rig (20) so it can be reefed without altering the remainder of rig (20).

8 Claims, 10 Drawing Sheets

CORNER REEFING SAIL

BACKGROUND—FIELD OF INVENTION

The invention relates to the field of sails of the type found on sailboards and sailboats in which the sail area is easily adjustable to suit various wind conditions.

BACKGROUND—DESCRIPTION OF PRIOR ART

All prior art for reefing have suffered from one or more of the following disadvantages:

(a) required complicated specialized mast or boom designs to accommodate the reefing method;

(b) required releasing the sail tension in order to reposition the sail on the spars or change sail dimensions before restoring tension to the sail;

(c) required considerable crew work to handle and furl the sail cloth.

Previous designs to reef sail area have targeted:

(a) changing the lower edge of sail;

(b) changing the trailing edge of the sail;

(c) changing the leading edge of the sail.

Removing the foot area of the sail, such as U.S. Pat. No. 4,706,591 to Reynolds (1987), required changing mast length, releasing all sail cloth tension, and required considerable crew work.

The auxiliary trailing edge sail of U.S. Pat. No. 5,272,996 to Drexler (1993) required additional complex sliding batten spars.

Objects and Advantages

Several objects of the corner reefing sail are:

(a) allow use of standard mast and boom;

(b) allow reefing while sailing by use of line arrangements;

(c) minimize crew work by not releasing sail tension;

(d) improve sail handling and control in strong winds by moving the sail center of effort forward or downward.

Taken together, the above objects lead to the prime object to provide a sail that allows high speed sailing in a wide range of wind speeds.

In order to most efficiently accomplish these objects, different parts of the sail than targeted by prior art will be reefed. In the preferred embodiment of the corner reefing sail, the rear corner of the triangular sail, the clew, will be reefed. In an alternate embodiment, the top corner of the sail, the head, will be targeted for reefing.

Still further objects and advantages will become apparent from a consideration of the ensuing description and drawings.

DRAWING FIGURES

REFERENCE NUMERALS IN DRAWINGS

Figure 1:
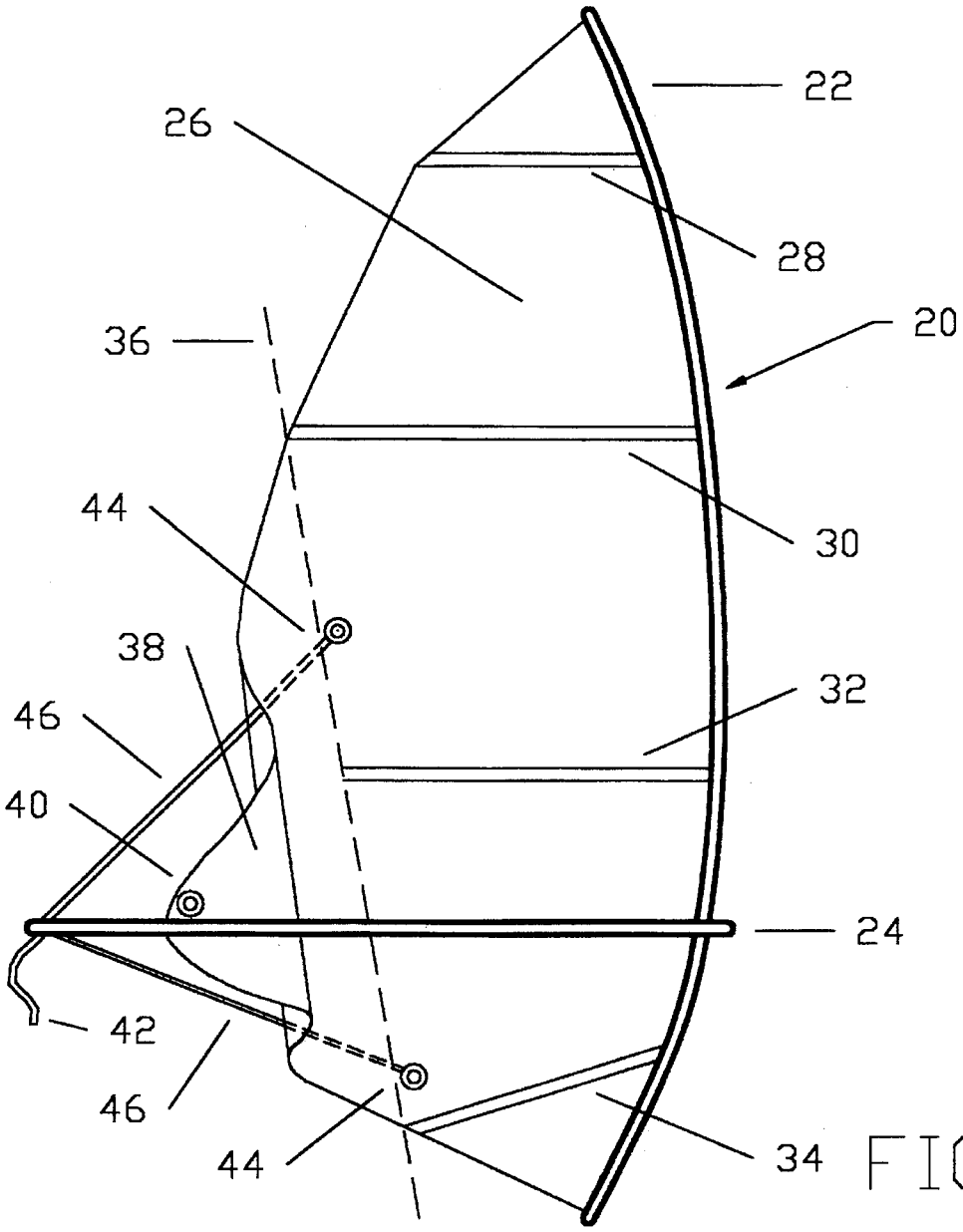
FIG. 1 shows a side view of a windsurfing sail with the clew reefing structure.

20 standard windsurfing rig
22 standard mast
24 standard wishboom
26 cloth sail
28 batten
30 batten
32 batten
34 batten
36 folding line
38 clew sail
40 standard outhaul grommet
42 standard outhaul line
44 clew grommet
46 clew line
48 unfurling line
50 cloth pocket
52 furling line
54 pulley
56 pulley
58 pulley
60 pulley
62 jam cleat
64 jam cleat
68 reefing points
70 zipper
72 line of holes
74 vertical batten
76 high wind clew sail
78 conventional boom
80 folding line
82 head sail
84 head cap
86 halyard line
88 halyard grommet
90 head grommet
92 head line
94 pocket luff

96 reefing points
98 zipper
100 high wind head sail
102 cloth pocket
104 pulley
106 jam cleat
108 jam cleat
110 furling line
112 unfurling line DESCRIPTION—FIG. 1 to 19

In the detailed description of the corner reefing sail that follows, it will be described in conjunction with a sailboard. Although the corner reefing sail may find its principal utility when used with a sailboard, it should be noted at the outset that with minor modifications which would be apparent to those skilled in the pertinent arts, the corner reefing sail can be incorporated into all sailboats of varying configurations as well as other types of wind-driven craft.

FIG. 1 shows a standard windsurfing rig 20 modified to allow reefing. The aft corner of rig 20 is known as tile clew and this is the part of rig 20 that will be reefed in the preferred embodiment of the corner reefing sail. Rig 20 has a standard mast 22, a standard wishboom 24, a cloth sail 26 and sail battens 28, 30, 32, and 34. Cloth sail 26 is unmodified forward of a folding line 36. Behind line 36, cloth sail 26 forms a clew sail 38 which is modified to allow reefing.

Clew sail 38 is unbattened in the simplest embodiment of the clew reefing sail. Battens 30, 32 and 34 of cloth sail 26 terminate at folding line 36.

Cloth sail 26 has two clew grommets 44, both on folding line 36, and a clew line 46 which is tied between both clew grommets 44. A standard outhaul line 42, attached to the aft end of wishboom 24, is tied to the mid-point of clew line 46. This transfers the sail tension from sail 26 to wishboom 24, bypassing clew sail 38 which can remain untensioned.

A standard outhaul grommet 40 on clew sail 38 can also be tied to standard out haul line 42 to tension clew sail 38.

Clew sail 38 is no longer a structural part of rig 20 and can be reefed, furled or removed without disturbing cloth sail 26 ahead of line 36. The tension normally carried by clew sail 38 is carried by clew line 46 from the aft end of wishboom 24 to clew grommets 44.

Figure 2:
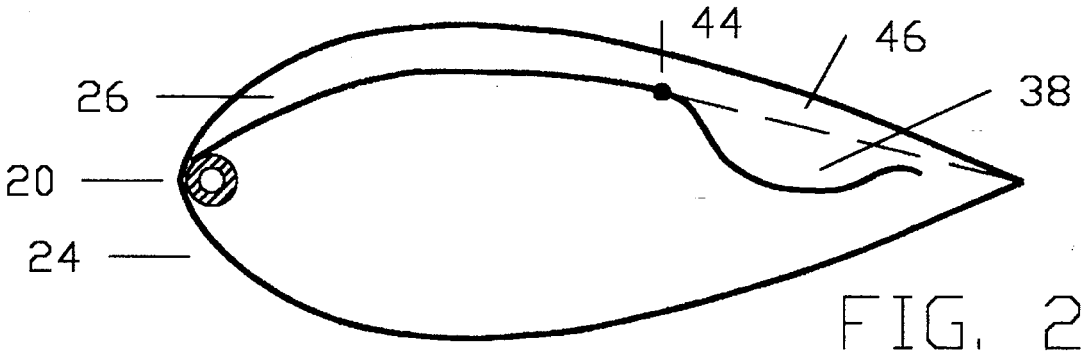
FIG. 2 shows the top view of a windsurfing sail with the clew reefing structure.

FIG. 2 shows the top view of rig 20. This view shows the preferred embodiment with clew line 46 located off to one side of clew sail 38.

Figure 3:
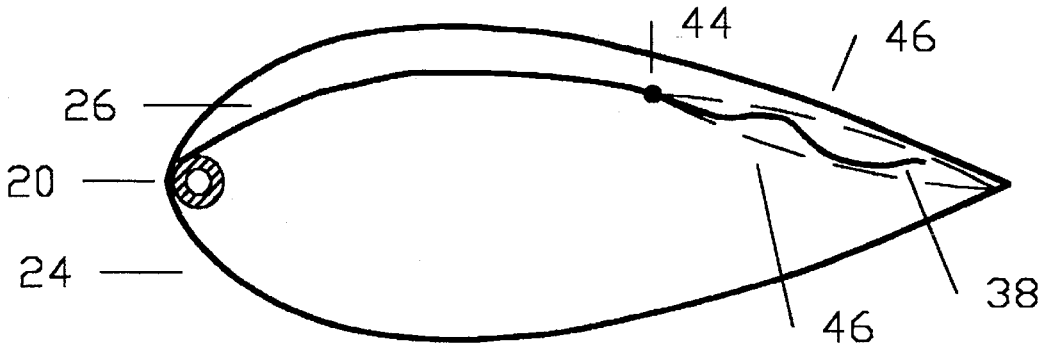
FIG. 3 shows the top view of a windsurfing sail with an alternate embodiment of the clew reefing structure.

FIG. 3 shows an alternate embodiment with twin clew lines 46, with one located on each side of clew sail 38.

Figure 4:
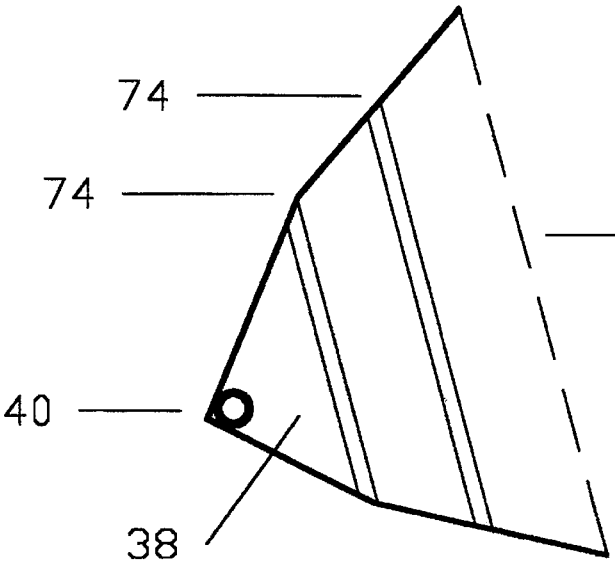
FIG. 4 shows an alternate embodiment of the clew reefing structure using battens in the clew.

FIG. 4 shows an alternate embodiment with vertical battens 74 in clew sail 38. Vertical battens 74 do not interfere with reefing as horizontal batten would.

Figure 5:
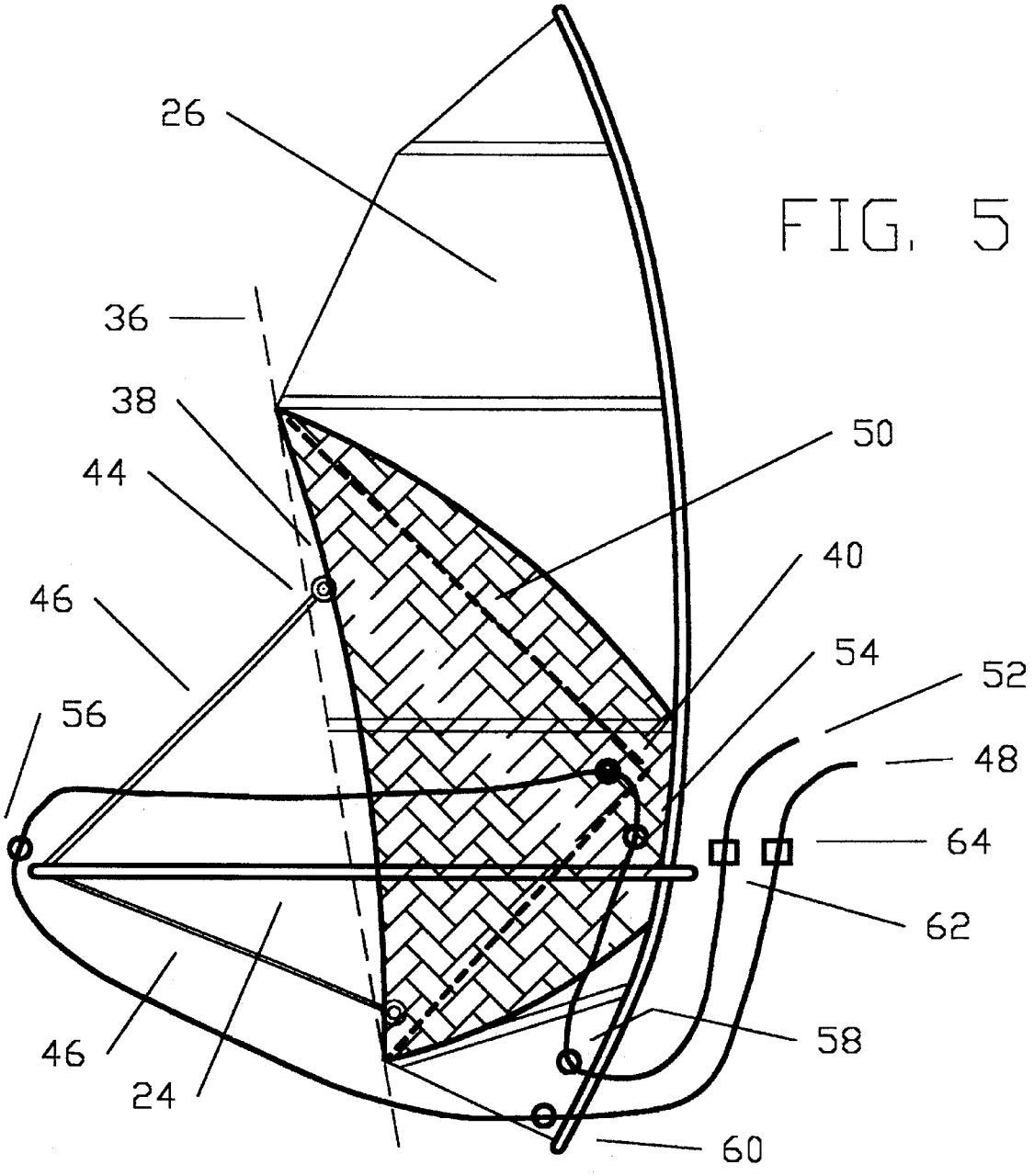
FIG. 5 shows the preferred embodiment of the clew reefing method with the clew furled into a pocket.

FIG. 5 shows the preferred means for reefing the untensioned clew sail 38. A cloth pocket 50, with an opening facing aft, is sewn onto cloth sail 26 to store clew sail 38 out of the air flow. A furling line 52 is lead from standard outhaul grommet 40, into pocket 50, through a pulley 54 and a pulley 58 which are attached to cloth sail 26. A jam cleat 62 holds tension in furling line 52. An unfurling line 48 is lead from standard outhaul grommet 40 through a pulley 56 attached to the aft end of wishboom 24 (not shown) and through a pulley 60 attached to cloth sail 26. A jam cleat 64 holds tension in unfurling line 48. Tensioning unfurling line 48 will pull clew sail 38 out of pocket 50. Jam cleat 62 and 64 are tied to the front of wishboom 24 (not shown).

Figure 6:
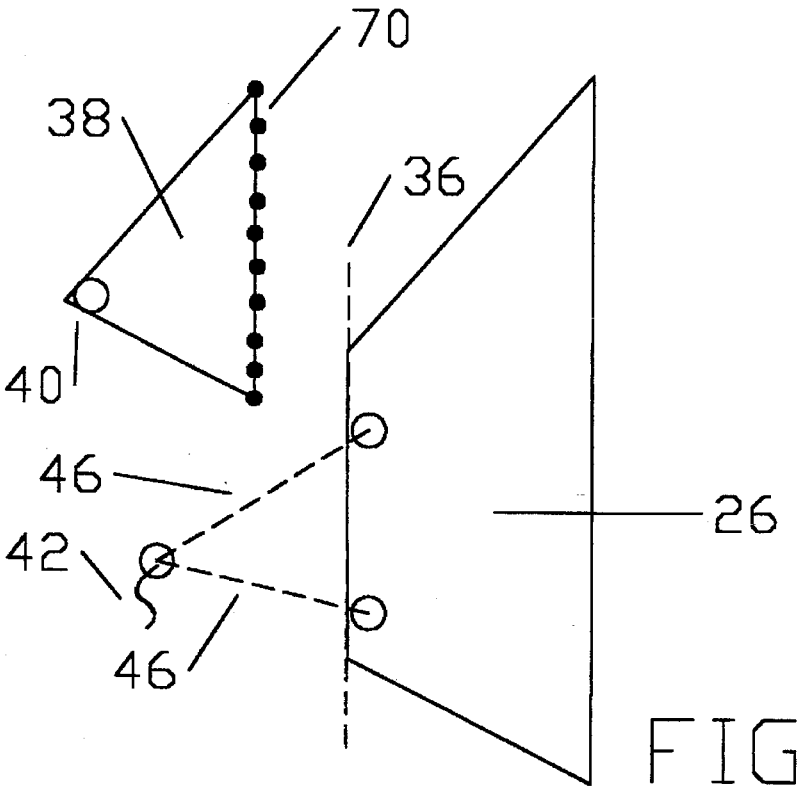
FIG. 6 shows an alternate embodiment of the clew reefing method with the clew detached from the sail.

FIG. 6 shows an alternate embodiment of the reefing method with a zipper 70 along line 36 to allow removal of clew sail 38 from cloth sail 26.

Figure 7:
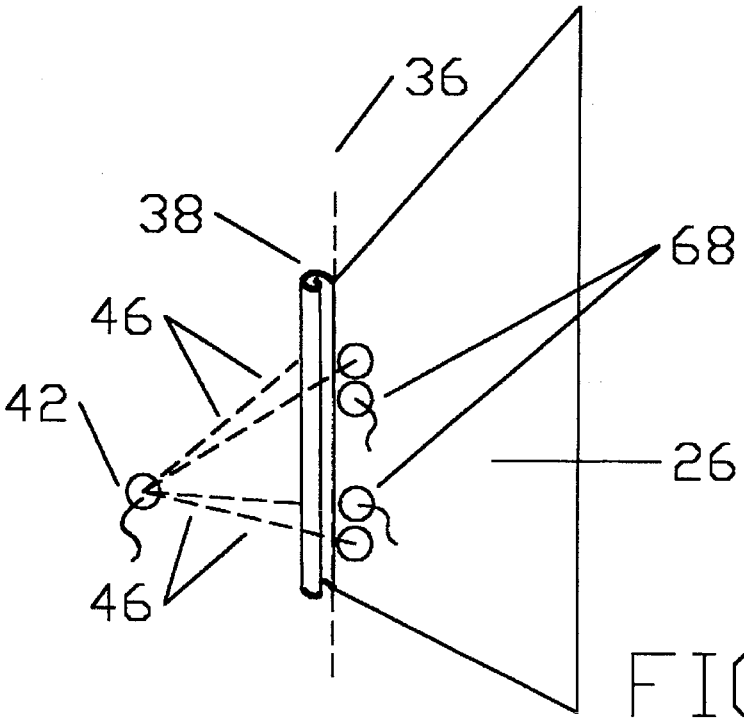
FIG. 7 shows an alternate embodiment of the clew reefing method with the clew rolled up.

FIG. 7 shows an alternate embodiment of the reefing method that rolls up clew sail 38. Clew sail 38 is rolled up between the twin clew line 46 of FIG. 3. Using a pair of reefing points 68, common for sail reefing, rolled clew sail 38 is held in the reefed position.

Figure 8:
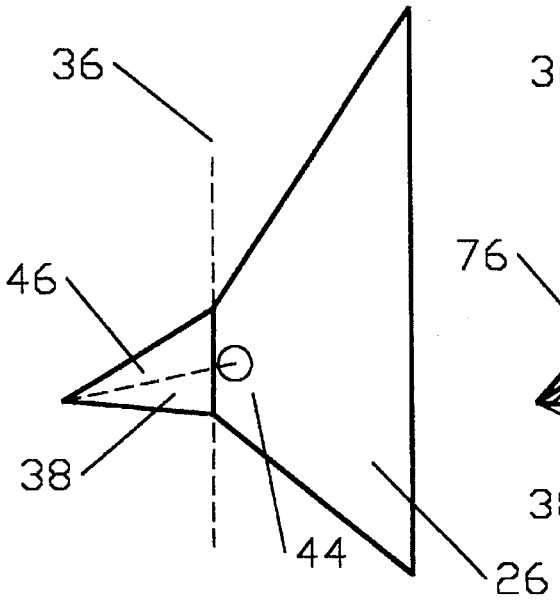
FIG. 8 shows an alternate embodiment of the clew reefing structure with a single clew grommet and clew line.

FIG. 8 shows an alternate embodiment will, a single clew grommet 44 and a single clew line 46. This embodiment is simpler but reduces the clew area that can reefed.

Figure 9:
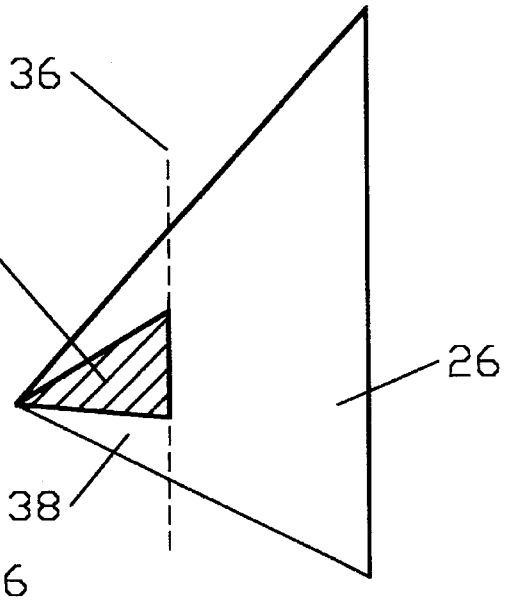
FIG. 9 shows an alternate embodiment of the clew reefing structure with a cloth clew structure.

FIG. 9 shows an alternate embodiment that uses a cloth structure replacing clew grommet 44 and clew line 46. In this embodiment, a smaller high wind clew sail 76, remains when clew sail 38 is furled. High wind clew sail 76 is positioned adjacent to clew sail 38.

Figure 10:
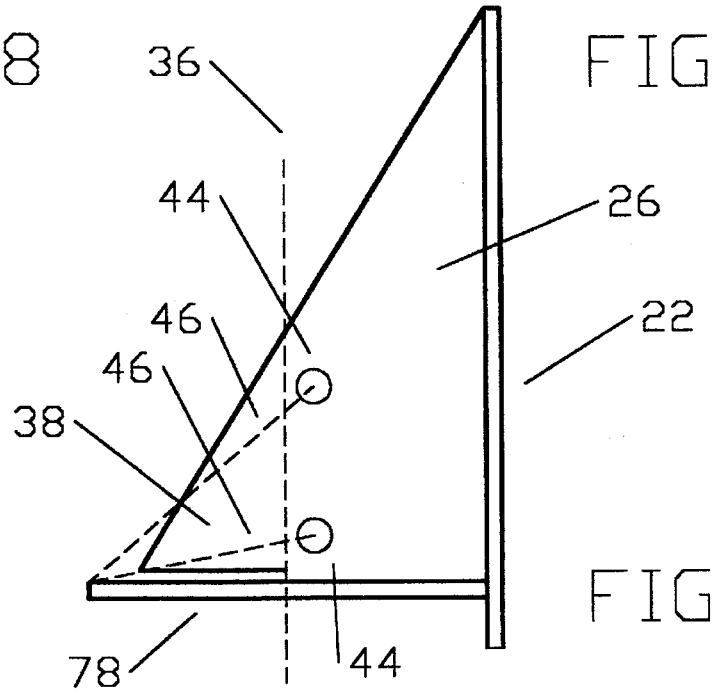
FIG. 10 shows an alternate embodiment of the clew reefing structure with a conventional boom.

FIG. 10 shows a alternate embodiment of the corner reefing sail on a more conventional rig with a conventional boom 78.

Figure 11:
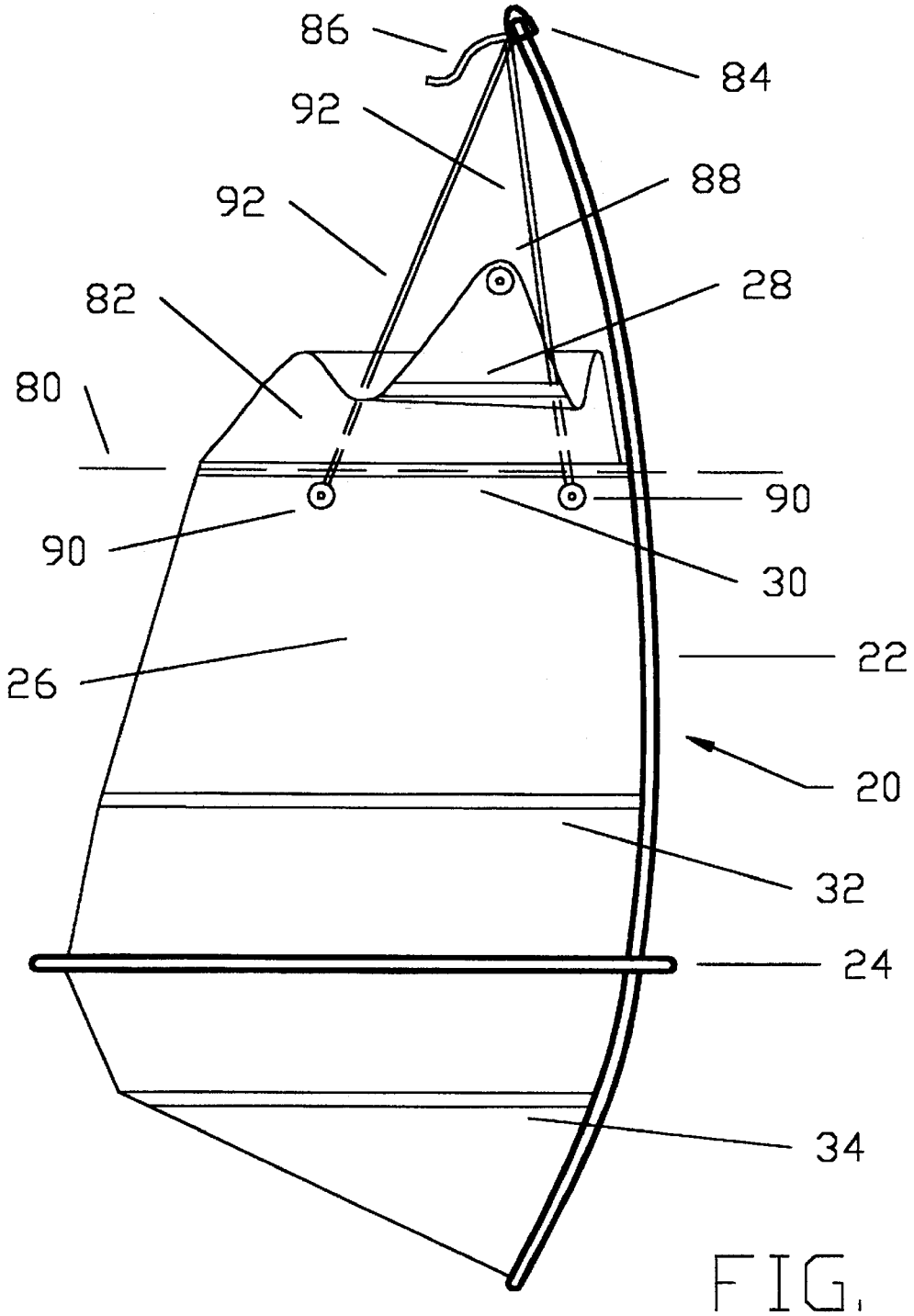
FIG. 11 shows a side view of a windsurfing sail with the head reefing structure.

FIG. 11 shows standard windsurfing rig 20 modified to allow reefing in an alternate embodiment of the corner reefing sail. The top corner of rig 20 is known as the head and this is the part of rig 20 that will be reefed. Cloth sail 26 is unmodified below a folding line 80. Above line 80, cloth sail 26 forms a head sail 82 which is modified to allow reefing.

Cloth sail 26 has two head grommets 90, both on folding line 80, and a head line 92 which is tied between both head grommets 90. A halyard line 86, attached to a head cap 84 on the top of mast 22, is tied to the mid-point of head line 92. This transfers the sail tension from sail 26 to the top of mast 22, bypassing head sail 82 which can remain untensioned.

A halyard grommet 88 on head sail 82 can also be tied to halyard line 86 to tension head sail 82.

Head sail 82 is no longer a structural part of rig 20 and can be reefed, furled or removed without disturbing cloth sail 26 below line 80. Head sail 82 is not attached to mast 22 in the simplest embodiment of the head reefing sail. The tension normally carried by head sail 82 is carried by head line 92 from the top of mast 22 to head grommets 90.

Figure 12:
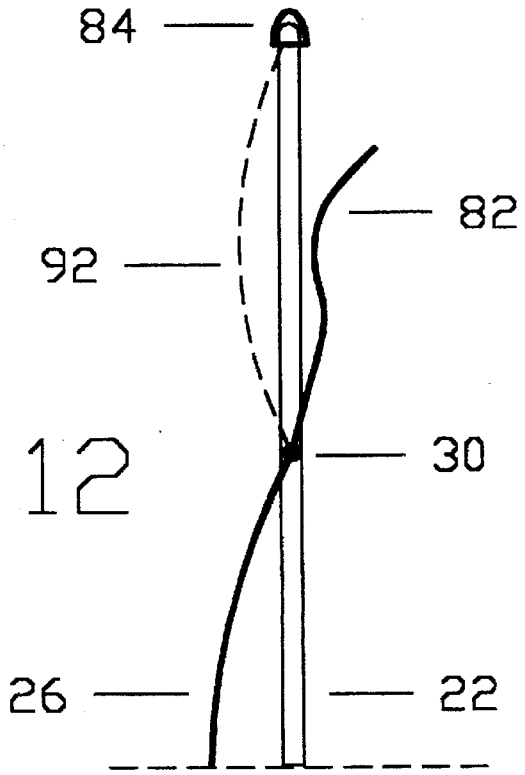
FIG. 12 shows the end view of a windsurfing sail with the head reefing structure.

FIG. 12 shows the end view of rig 20. This view shows the preferred embodiment with head line 92 located off to one side of head sail 82.

Figure 13:
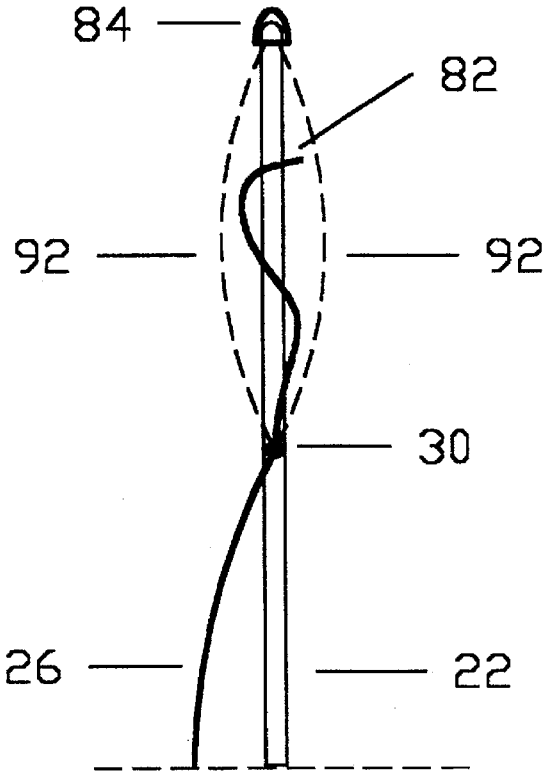
FIG. 13 shows the end view of a windsurfing sail with an alternate embodiment of the head reefing structure.

FIG. 13 shows an alternate embodiment with twin bead lines 92, with one located on each side of head sail 82.

Figure 14:
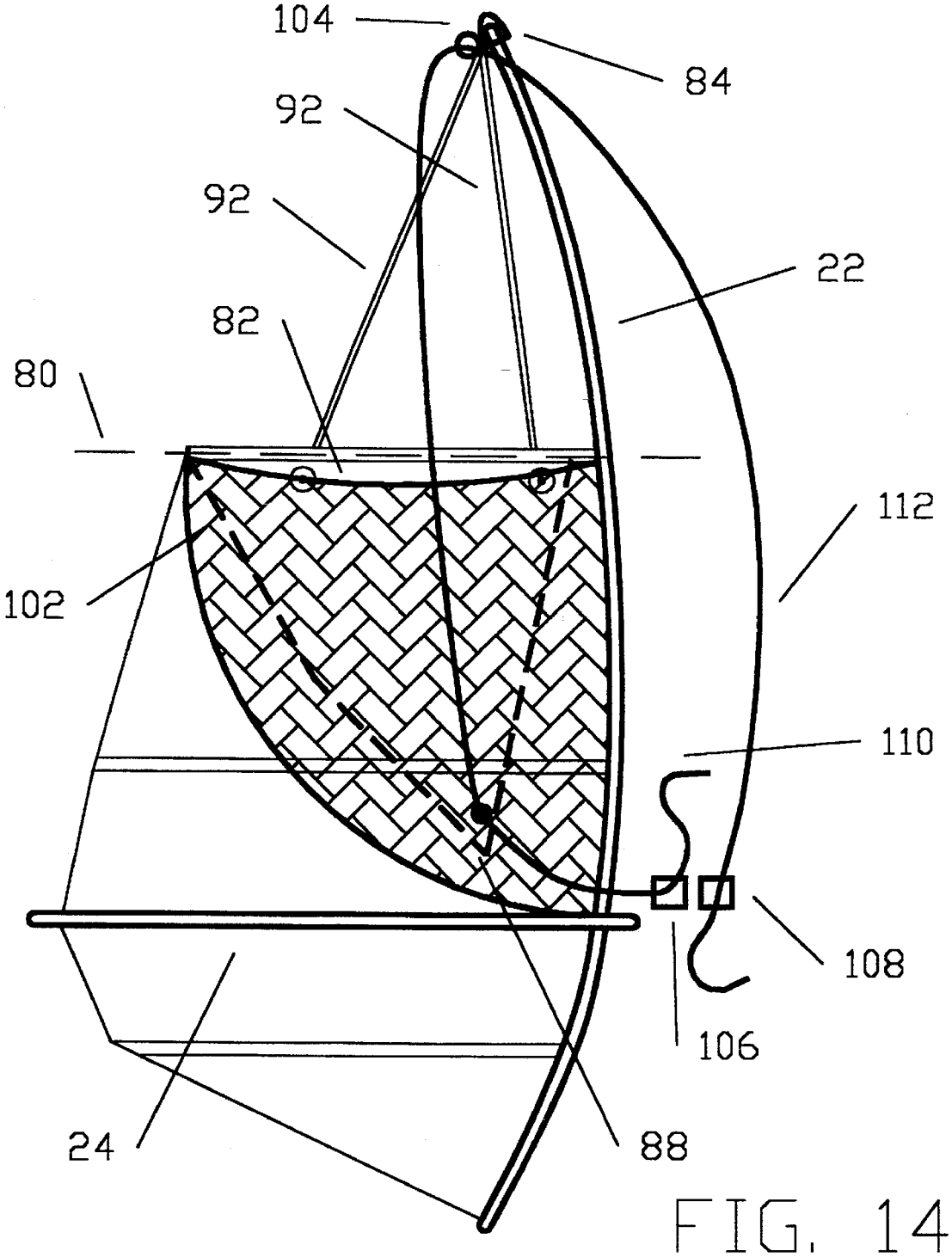
FIG. 14 shows the preferred embodiment of the head reefing method with the head furled into a pocket.

FIG. 14 shows the preferred means for reefing the untensioned head sail 82. A cloth pocket 102, with an opening facing up, is sewn onto cloth sail 26 to store head sail 82 out of the air flow. A furling line 110 is lead from halyard grommet 88, into pocket 102, and through a jam cleat 106 which, holds tension in furling line 110. An unfurling line 112 is lead from halyard grommet 88 through a pulley 104 attached to head cap 84 and through a jam cleat 108. Jam cleat 108 holds tension in unfurling line 112. Tensioning unfurling line 112 will pull head sail 82 out of pocket 102. Jam cleat 106 and 108 are tied to the front of wishboom 24 (not shown).

Figure 15:
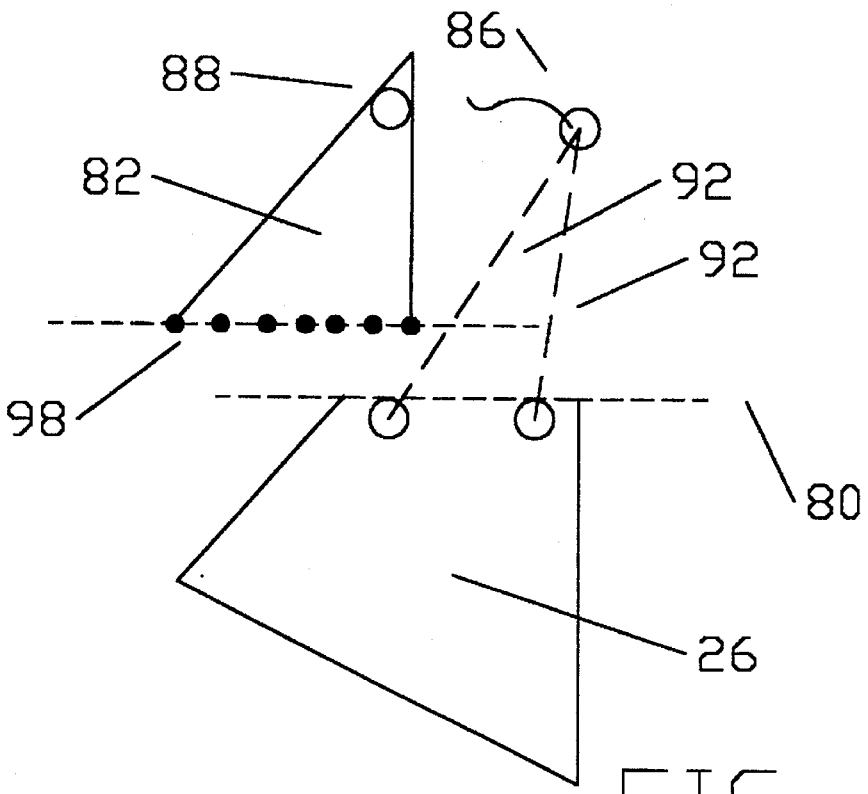
FIG. 15 shows an alternate embodiment of the head reefing method will, the head detached from the sail.

FIG. 15 shows an alternate embodiment of the reefing method with a zipper 98 along line 80 to allow removal of head sail 82 from cloth sail 26.

Figure 16:
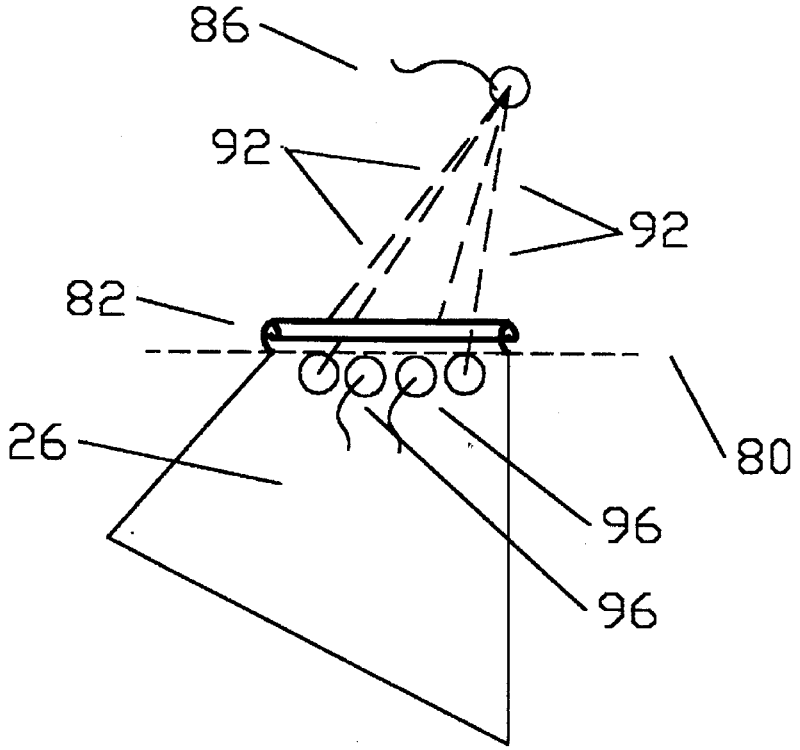
FIG. 16 shows an alternate embodiment of the head reefing method with the head rolled up.

FIG. 16 shows an alternate embodiment of the reefing method that rolls up head sail 82. Head sail 82 is rolled tip between the twin head line 92 of FIG. 13. Using two reefing points 96, common for sail reefing, the rolled head sail 82 is held in the furled position.

Figure 17:
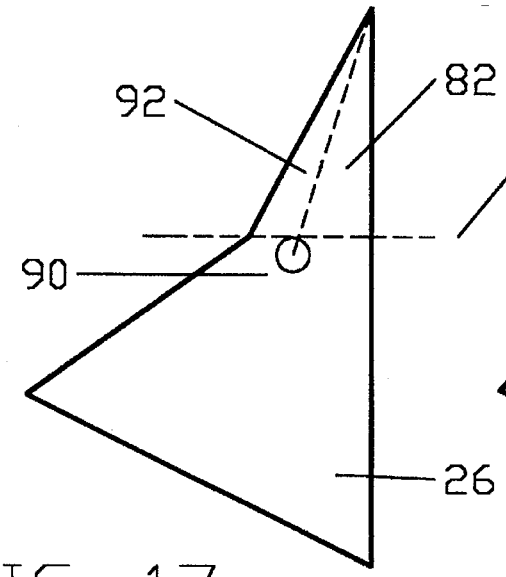
FIG. 17 shows an alternate embodiment of the head reefing structure with a single head grommet and head line.

FIG. 17 shows an alternate embodiment with a single head grommet 90 and a single head line 92. This embodiment is simpler but reduces the head area that can reefed.

Figure 18:
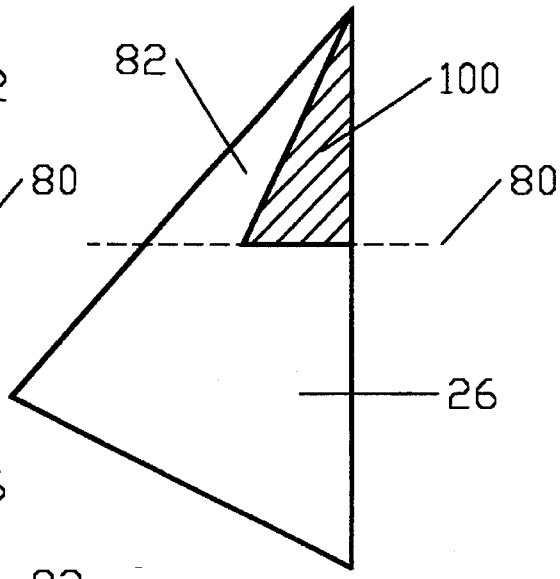
FIG. 18 shows an alternate embodiment of the head reefing structure with a cloth head structure.

FIG. 18 shows an alternate, embodiment that uses a cloth structure replacing bead grommet 90 and bead line 92. In this embodiment, a smaller high wind head sail 100, remains when head sail 82 is furled. High wind head sail 100 is positioned adjacent to head sail 82.

Figure 19:
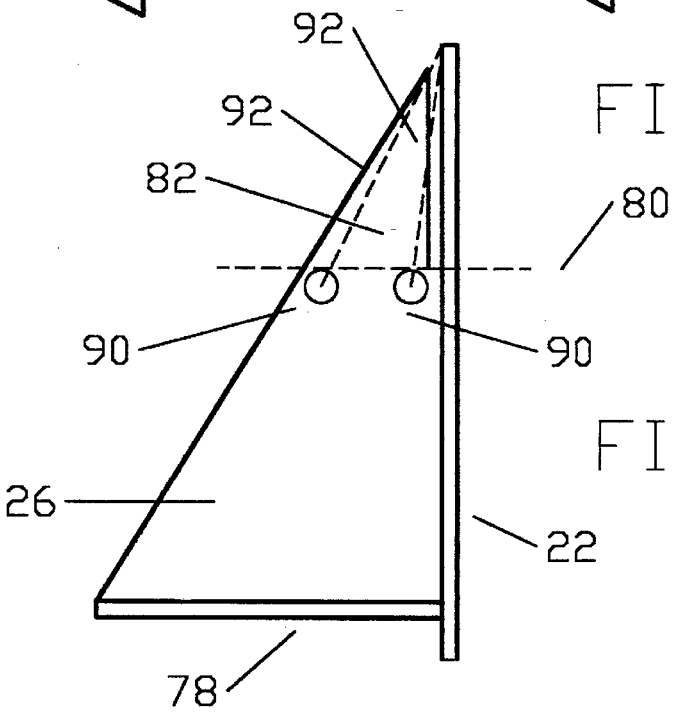
FIG. 19 shows an alternate embodiment of the head reefing structure with a conventional boom.

FIG. 19 shows a alternate embodiment of the corner reefing sail on a more conventional rig with conventional boom 78.

OPERATION—FIG. 1 TO 19

In FIG. 1, mast 22, wishboom 24, and sail cloth 26 are assembled in the standard manner with standard outhaul line 42 tied to the mid-point of clew line 46 instead of standard outhaul grommet 40. The shape of cloth sail 26 is not affected by use of clew grommet 44 and clew line 46 rather than standard outhaul grommet 40 and standard outhaul line 42.

Four different reefing methods are illustrated using FIG. 5, FIG. 6, and FIG. 7.

In FIG. 5, the preferred embodiment, the crew releases tension in jam cleat 62 and then pulls on unfurling line 48 to unreef clew sail 38. This will pull clew sail 38 out of cloth pocket 50 and pull standard outhaul grommet 40 to the aft end of wishboom 24 (not shown). Jam cleat 64 will hold the tension in unfurling line 48.

To reef clew sail 38 in FIG. 5, the crew releases tension in jam cleat 64 and then pulls on the end of furling line 52. This will pull clew sail 38 inside cloth pocket 50. Jam cleat 62 will hold the tension in furling line 52.

The crew actions to reef and unreef are quick and easy, distracting the sailor only momentarily from the task of balancing rig 20 and can be accomplished while sailing at high speed.

To reef clew sail 38 in FIG. 6, the crew will need to stop sailing and lay rig 20 down in the water. Standard outhaul line 42 is untied from standard outhaul grommet 40 removing tension from clew sail 38. Clew sail 38 is then separated from cloth sail 26 by use of zipper 70. The separated clew sail 38 is then stored on the crew.

To unreef clew sail 38 in FIG. 6, the crew will need to stop sailing and lay riff 20 down in the water. The separated clew sail 38 will need to be retrieved from storage and reattached to sail cloth 26 by means of zipper 70. Standard outhaul line 42 is then tied to standard outhaul grommet 40 to tension clew sail 38.

To reef clew sail 38 in FIG. 7, the crew will need to stop sailing and lay rig 20 down in the water. Standard outhaul line 42 is untied from standard outhaul grommet 40 removing tension from clew sail 38. Clew sail 38 is then manually rolled, between the twin clew lines 46 of FIG. 3, towards folding line 36. The crew then ties reefing points 68 to hold the rolled clew sail 38. The twin clew lines 46 also help hold the rolled clew sail 38.

To unreef clew sail 38 in FIG. 7, the crew will need to stop sailing and lay rig 20 down in the water. The crew unties reefing points 68 and unrolls clew sail 38. Standard outhaul line 42 is then tied to standard outhaul grommet 40.

The alternate embodiment of FIG. 8 with single clew grommet 44 and clew line 46 requires a narrower clew sail 38 in order to prevent a large amount of deflection in sail 26 forward of folding line 36.

The alternate embodiment of FIG. 9 uses a high wind clew sail 76 when the initial clew sail 38 is furled. The smaller clew sail 76 reduces the affect of the shorter length of the reefed sail.

The alternate embodiment of FIG. 10 operates the same as the preferred embodiment. Sail 26 has an outline common on conventional dinghies and larger sailboats. Clew sail 38 cloth needs to be free from attachment to boom 78 to allow clew sail 38 to be pulled away from boom 78 when furled.

FIG. 11 shows the head sail furling embodiment of the corner reefing sail. Mast 22, wishboom 24, and sail cloth 26 are assembled in the standard manner with halyard line attached to head cap 84 on the top of mast 22, tied to the mid-point of head line 92 instead of halyard grommet 88. The shape of cloth sail 26 is not affected by use of head grommet 90 and head line 92.

Three different reefing methods are illustrated using FIG. 14, FIG. 15, and FIG. 16.

In FIG. 14, the preferred embodiment the crew releases tension in jam cleat 106 and then pulls on unfurling line 112 to unreef head sail 82. This will pull head sail 82 out of cloth pocket 102 and pull halyard grommet 88 to the top end of mast 22. Jam cleat 108 will hold the tension in unfurling line 112.

To reef head sail 82 in FIG. 14, the crew releases tension in jam cleat 108 and then pulls on the end of furling line 110. This will pull head sail 82 inside cloth pocket 102. Jam cleat 106 will hold the tension in furling line 110.

The crew actions to reef and unreef are quick and easy, distracting the sailor only momentarily from the task of balancing rig 20 and can be accomplished while sailing at high speed.

To reef head sail 82 in FIG. 15, the crew will need to stop sailing and lay rig 20 down in the water. Halyard line 86 is untied from halyard grommet 88 removing tension from head sail 82. Head sail 82 is then separated from cloth sail 26 by use of zipper 98. The separated head sail 82 is then stored on the crew.

To unreef head sail 82 in FIG. 15, the crew will need to stop sailing and lay rig 20 down in the water. The separated head sail 82 will need to be retrieved from storage and reattached to sail cloth 26 by means of zipper 98. Halyard line 86 is then tied to halyard grommet 88 to tension head sail 82.

To reef head sail 82 in FIG. 16, the crew will need to stop sailing and lay rig 20 down in the water. Halyard line 86 is untied from halyard grommet 88 removing tension from head sail 82. Head sail 82 is then manually rolled, between the twin head lines 92 of FIG. 13, towards folding line 80. The crew then ties reefing points 96 to hold the rolled head sail 82. The twin head lines 92 also help hold the rolled head sail 82.

To unreef head sail 82 in FIG. 16, the crew will need to stop sailing and lay rig 20 down in the water. The crew unties reefing points 96 and unrolls head sail 82. Halyard line 86 is then tied to halyard grommet 158.

The alternate embodiment of FIG. 17 with single head grommet 90 and head line 92 requires a narrower head sail 82 in order to prevent a large amount of deflection in sail 26 below folding line 80.

The alternate embodiment of FIG. 18 uses a high wind head sail 100 when the initial head sail 82 is furled. The smaller head sail 100 reduces the affect of the shorter height of the reefed sail.

The alternate embodiment of FIG. 19 operates the same as the other head sail reefing methods. Sail 26 has an outline common on conventional dinghies and larger sail. boats. Head sail 82 cloth needs to be free from attachment to mast 22 to allow head sail 82 to he pulled away from mast 22 when furled.

SUMMARY, RAMIFICATIONS, AND SCOPE

The basic structure of the corner reefing sail of FIG. 1 and FIG. 11 is very simple and light weight allowing equal performance to non-reefing sails. The sail retains standard cloth sail tensions and tension adjustment mechanisms. This allows the normal sail twist and shaping methods carefully designed into a sail to extend its wind speed range to be retained.

The corner reefing sail allows use of standard mast 22 and standard wishboom 24 by having the reefing structure contained within sail cloth 26. Jam cleat 62, 64, 106 and 108 can be easily attached to and removed from common attachment points on standard mast 22 and standard wishboom 24.

The corner reefing sail allows quick reefing while sailing. Using the reefing method shown in FIG. 5 or FIG. 14, the crew can quickly reef the sail by pulling on a line. The crew can continue sailing at high speed, so that reefing is possible while racing to achieve maximum performance in changing winds and improve sail control. When using the reefing methods shown in FIG. 6, FIG. 7, FIG. 15, and FIG. 16 the crew will need to stop sailing and drop the sail into the water. But clew sail 38 or head sail 82 can still reefed while out on the water without having to return to shore. This is an important advantage for recreational sailors to allow them to continue sailing fast and having fun in variable winds.

The corner reefing sail minimizes manual work for reefing. The high sail tensions in the main body of cloth sail 26 are not released and then re-applied again. Mast 22 and wishboom 24 do not need to be moved or altered in length. Cloth sail 26 does not need to be shifted on mast 22 or wishboom 24.

The corner reefing sail improves sail handling and control in strong winds. Reefing clew sail 38 provides the following advantages:

(a) Reefing the clew moves the center of sail force forward which counters the rearward movement that occurs in strong wind which reduce windsurfer sail control.

(b) Reefing the clew reduces the drag in the water that occurs on the clew during windsurfing uphaul and waterstarting maneuvers.

When uphauling, the crew stands on the hull and pulls the rig out of the water, mast first. The clew is the last part of the rig lifted out of the water and it drags though the water as the craft starts moving. This drag makes it much harder to pull the sail completely out of the water and reducing clew area will reduce this drag.

When waterstarting, the crew uses the wind to lift the sail out of the water, mast first. The clew is the last part of the rig lifted out of the water and the hardest part of the rig to lift. Reducing the clew area will make waterstarting easier.

Thus the reefing makes strong wind sail maneuvers easier which is just as important and just as necessary as reducing sail wind force.

(c) Reefing the clew improves the sail shape for high wind sailing by making the sail tall and narrow. The clew area generates high drag and little drive at the low angles of attack that occur in stronger winds.

(d) The effect of the reefing the clew is much greater than just the change in sail area. The reduction in sail length by the absence of the clew makes it easier for the crew to sheet the sail in strong winds and to over-sheet the sail to reduce sail force. In practice, a 7 square meter area sail, with a 1 square meter area clew sail 38, can be used as easily as a 5 square meter area sail in strong winds. The reefed 7 square meter area sail has a sail length that is shorter than the sail length of the 5 square meter area sail. The reduction in sail length is as significant a factor as the reduction in sail area for the ease of sailing in strong winds.

The alternate embodiment of corner reefing sail also improves sail handling and control in strong winds. Reefing head sail 82 provides the following advantages:

(a) Reefing head sail 82 moves the center of sail force downward to reduce the capsizing moment in the sail which overpowers the crew in strong wind.

(b) Reefing head sail 82 reduces the wind drag of the top of the sail making the sail easier to stand upright during the windsurfing uphaul maneuver in strong winds.

As a result of the advantages above, the corner reefing sail provides a sail that allows high speed sailing in a wide range of wind speed.

A corner reefing sail increases safety for the sailor, increases sailor confidence and allows beginners to self rescue when they lack high wind sailing skills. A corner reefing sail can be used for all sailing with the reefing mechanism lying dormant until an emergency situation. In strong winds, the crew can become too overpowered to sail, to uphaul, to waterstart, or sail effectively to windward. The crew can then use one of the simple reefing method of FIG. 6, FIG. 7, FIG. 15, and FIG. 16 while the craft is still out on the water. Once the sail is reefed, the crew can more easily sail, uphaul, waterstart, and sail effectively to windward in order to make it back to shore or continue sailing with greater control and enjoyment.

The complete nature of reefing: aiding sailing; uphauling; and waterstarting can make long distance windsurfer cruising more practical when there can be large changes in wind strength.

Although the description above contains many specificities, these should not be construed as limiting the scope of the invention, but as merely providing illustrations of some of the presently preferred embodiments of this invention. Thus the scope of the invention should be determined by the appended claims and their legal equivalents, rather than by the examples given.

I claim:

1. A reefing sail attached to a mast and a boom having a rearward end comprising:

(a) a sail, substantially triangular, having an upper comer area, a rear corner area having a forward edge, and a lower corner area;

(b) a plurality of clew grommets, said grommets attached to the forward edge of said rear corner area;

(c) a plurality of clew lines, said lines adjacent to said rear corner area and attached between said grommets and the rearward end of the boom;

(d) reefing means to reduce the size of said rear corner area exposed to the wind comprising a cloth pocket attached to said sail forward of said rear corner area with an opening and an area large enough to contain said rear corner area.

2. The reefing sail attached to a mast and a boom having a rearward end of claim 1 further including a plurality of battens, said battens extending substantially horizontal across said sail and terminating at the forward edge of said rear corner area.

3. A reefing sail attached to a mast and a boom having a rearward end comprising:

(a) a sail, substantially triangular, having an upper corner area, a rear corner area having a forward edge, and a lower corner area;

(b) a separate sail of flexible material, said separate sail attached at a plurality of points to the forward edge of said rear corner area, adjacent to said rear corner area, and attached to the rearward end of the boom;

(c) reefing means to reduce the size of said rear corner area exposed to the wind comprising a cloth pocket attached to said sail forward of said rear corner area with an opening and an area large enough to contain said rear corner area.

4. The reefing sail attached to a mast and a boom having a rearward end of claim 3 further including a plurality of battens, said battens extending substantially horizontal across said sail and terminating at the forward edge of said rear corner area.

5. A reefing sail attached to a mast having an upper end, and a boom comprising:

(a) a sail, substantially triangular, having an upper corner area having a lower edge, a rear corner area, and a lower corner area;

(b) a plurality of head grommets, said grommets attached to the lower edge of said upper corner area;

(c) a plurality of head lines, said lines adjacent to said upper corner area and attached between said grommets and the upper end of the mast;

(d) reefing means to reduce the size of said upper corner area exposed to the wind comprising a cloth pocket attached to said sail below said upper corner area with an opening and an area large enough to contain said upper corner area.

6. The reefing sail attached to a mast having an upper end, and a boom of claim 5 further including a plurality of battens, said battens extending substantially horizontal across said sail.

7. A reefing sail attached to a mast having an upper end, and a boom comprising:

(a) a sail, substantially triangular, having an upper corner area having a lower edge, a rear corner area, and a lower corner area;

(b) a separate sail of flexible material, said separate sail attached at a plurality of points to the lower edge of said upper corner area, adjacent to said upper corner area, and attached to the upper end of the mast;

(c) reefing means to reduce the size of said upper corner area exposed to the wind comprising a cloth pocket attached to said sail below said upper corner area with an opening and an area large enough to contain said upper corner area.

8. The reefing sail attached to a mast having an upper end, and a boom of claim 7 further including a plurality of battens, said battens extending substantially horizontal across said sail.

* * * * *